US006044909A

United States Patent [19]

Gano

[11] Patent Number: 6,044,909

[45] Date of Patent: Apr. 4, 2000

[54] APPARATUS AND METHODS FOR LOCATING TOOLS IN SUBTERRANEAN WELLS

[75] Inventor: John C. Gano, Carrollton, Tex.

[73] Assignee: Halliburton Energy Services, Inc., Houston, Tex.

[21] Appl. No.: 08/984,905

[22] Filed: Dec. 4, 1997

[51] Int. Cl.[7] ..... E21B 23/03; E21B 43/14

[52] U.S. Cl. ..... 166/381; 166/117.5; 166/237; 166/242.6

[58] Field of Search ..... 166/50, 117.5, 166/117.6, 237, 242.1, 242.6, 242.7

[56] References Cited

U.S. PATENT DOCUMENTS

| | | | |
|---|---|---|---|
| 2,397,070 | 3/1946 | Zublin . | |
| 2,452,920 | 11/1948 | Gilbert . | |
| 2,797,893 | 7/1957 | McCune et al. . | |
| 2,858,107 | 10/1958 | Colmerauer . | |
| 4,396,075 | 8/1983 | Wood et al. | 175/79 |
| 4,402,551 | 9/1983 | Wood et al. | 299/5 |
| 4,406,325 | 9/1983 | Bowyer | 166/214 |
| 4,415,205 | 11/1983 | Rehm et al. | 299/5 |
| 4,437,522 | 3/1984 | Krause, Jr. et al. | 166/382 |
| 4,444,276 | 4/1984 | Peterson, Jr. | 175/61 |
| 4,573,541 | 3/1986 | Josse et al. | 175/78 |
| 4,664,187 | 5/1987 | Wienberg | 166/382 X |
| 4,726,421 | 2/1988 | Akkerman et al. | 166/117.5 |
| 4,807,704 | 2/1989 | Hsu et al. | 166/313 |
| 4,944,351 | 7/1990 | Eriksen et al. | 166/376 |
| 5,318,122 | 6/1994 | Murray et al. | 166/313 |
| 5,353,876 | 10/1994 | Curington et al. | 166/313 |
| 5,361,834 | 11/1994 | Cox | 166/120 |
| 5,388,648 | 2/1995 | Jordan, Jr. | 166/380 |
| 5,501,281 | 3/1996 | White et al. | 166/387 |
| 5,520,252 | 5/1996 | McNair | 166/313 |
| 5,564,503 | 10/1996 | Longbottom et al. | 166/313 |
| 5,566,763 | 10/1996 | Williamson et al. | 166/382 |
| 5,613,559 | 3/1997 | Williamson et al. | 166/381 |

FOREIGN PATENT DOCUMENTS 2 282 835 4/1995 United Kingdom .

*Primary Examiner*—George Suchfield
*Attorney, Agent, or Firm*—Jenkens & Gilchrist

[57] ABSTRACT

Temporary no-go assemblies for use in locating a downhole tool at a predetermined target depth in a well are disclosed. Certain ones of the assemblies include a no-go sleeve for interfacing with a no-go shoulder in a casing and an actuating system for releasing the assembly from the no-go sleeve. Other ones of the assemblies include a key for engaging a landing nipple in a casing and a key retractor for retracting the key from the nipple. Still other ones of the assemblies include a key for engaging a no-go shoulder in a casing and a key retractor for retracting the key from the no-go shoulder. The assemblies are particularly useful in drilling and completing wells from a floating drilling rig.

23 Claims, 9 Drawing Sheets

APPARATUS AND METHODS FOR LOCATING TOOLS IN SUBTERRANEAN WELLS

FIELD OF THE INVENTION

The present invention pertains to the drilling and completion of subterranean wells, and, more particularly, but not by way of limitation, to improved apparatus and methods for precisely locating tools relative to a predetermined target depth in such wells. Still more particularly, but not by way of limitation, the present invention pertains to improved apparatus and methods for precisely locating tools relative to a predetermined target depth in offshore, multilateral wells drilled from a floating drilling rig.

HISTORY OF THE RELATED ART

Before running certain critical downhole processes during the drilling or completion of a subterranean well, one must first determine the target depth for the process. Once this target depth is determined, a downhole tool is typically run into the well and located at the target depth within a specific tolerance. When drilling on-shore wells or when drilling from a fixed platform offshore, conventional tools such as a gamma ray survey tool or a collar log are typically utilized in order to position a downhole tool relative to the predetermined target depth. When the gamma ray survey tool indicates that the downhole tool is at the proper depth, the tool is typically fixed at this depth using a conventional anchoring system, such as a packer.

FIG. 1 illustrates a conventional floating drilling rig or "floater" 10. Floater 10 generally comprises a drilling rig 12, a semi-submersible 14, and a casing 16. Semi-submersible 14 floats on, and supports drilling rig 12 proximate to, the surface of ocean 18. Although not shown in FIG. 1, semi-submersible 14 is anchored to a surface 20 of ocean floor 22 by conventional anchoring means. Casing 16 extends from drilling rig 12, through ocean 18, and into ocean floor 22. A predetermined target depth 24 within ocean floor 22 has been determined for a downhole process.

When drilling offshore from conventional floater 10, it is extremely difficult, and sometimes impossible, for conventional equipment such as a gamma ray survey tool to accurately indicate the depth of a downhole tool relative to target depth 24. This problem occurs because, in contrast to on-shore drilling or offshore drilling from a fixed platform, waves on the surface of ocean 18 continually move semi-submersible 14, and a work string supporting a downhole tool within casing 16, in a vertical direction.

One conventional technique used to address this problem is illustrated in FIG. 2. As shown in FIG. 2, casing 16 has been installed in a wellbore 26 within ocean floor 22. Casing 16 has been formed with a no-go shoulder 30. In addition, a work string 28 has been formed with a fixed no-go sleeve 32. A downhole tool 34 and a conventional mechanically or hydraulically actuated anchoring system 36, such as a packer, have been coupled to work string 28 below fixed no-go sleeve 32.

Work string 28 is run into casing 16 until fixed no-go sleeve 32 rests on no-go shoulder 30. If anchoring system 36 is solely hydraulically set, downhole tool 34 is located at target depth 24 when fixed no-go sleeve 32 is resting on no-go shoulder 30.

With a hydraulically actuated anchoring system 36, work string 28 is pressured up to set anchoring system 36. However, this hydraulic pressure often causes a "ballooning effect" in work string 28, resulting in work string 28 stretching several inches below no-go shoulder 30. Such stretching moves downhole tool 34 several inches from its desired target depth 24, potentially endangering the success of the downhole process to be performed by downhole tool 34. This ballooning effect may also place portions of work string 28 in residual tension or compression. When work string 28 is pressured down after anchoring system 36 is set, this residual tension and compression is transferred to, and may damage, downhole tool 34.

To set a mechanically actuated anchoring system 36, work string 28 is first lifted above no-go shoulder 30, as indicated by position 38 of fixed no-go sleeve 32 shown in dashed lines in FIG. 2. This lifting attempts to locate downhole tool 34 exactly at target depth 24. Some work string weight is then used to set anchoring system 36, such as, by way of example, releasing tension in the conventional rig hoist system on semi-submersible 14 supporting work string 28. As will be appreciated by one skilled in the art, such lifting of no-go sleeve 32 is necessary so that the setting force is transmitted to anchoring system 36 instead of no-go shoulder 30. However, due to inaccuracies involved in such lifting, downhole tool 34 may not be positioned exactly at target depth 24. This potential problem endangers the success of the downhole process to be performed by downhole tool 34.

Of course, with an anchoring system 36 that is initially hydraulically and then fully mechanically set, all of the above-described problems may occur.

Therefore, a need exists in the petroleum industry for improved apparatus and methods for precisely locating downhole tools relative to a predetermined target depth in offshore wells drilled from a floating drilling rig. One specific application that requires repeated, precision locating of a downhole tool relative to a predetermined target depth, and thus is particularly susceptible to the above-described problems, is the drilling and completion of offshore, multilateral wells drilled from floating drilling rigs. As used in this document, a multilateral well is a well having a substantially vertical main wellbore that contains multiple wellbores extending generally laterally from the main wellbore. Multilateral wells allow an increase in the amount and rate of production by increasing the surface area of the wellbores in contact with the reservoir, or reservoirs. Thus, multilateral wells are becoming increasingly important, both from the standpoint of new drilling operations and from the reworking of existing wellbores, including remedial and stimulation work.

The problem of lateral wellbore (and particularly multilateral wellbore) completion has been recognized for many years, as reflected in the patent literature. For example, U.S. Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U.S. Pat. No. 2,397,070 similarly describes lateral wellbore completion using flexible casing together with a closure shield for closing off the lateral. In U.S. Pat. No. 2,858,107, a removable whipstock assembly provides a means for locating (e.g. accessing) a lateral subsequent to completion thereof. U.S. Pat. Nos. 4,396,075; 4,415,205; 4,444,276; and 4,573,541 all relate generally to methods and devices for multilateral completions using a template or tube guide head. Other patents of general interest in the field of horizontal well completion include U.S. Pat. Nos. 2,452,920 and 4,402,551.

More recently, U.S. Pat. Nos. 5,318,122; 5,353,876; 5,388,648; and 5,520,252 have disclosed methods and apparatus for sealing the juncture between a vertical well and one or more horizontal wells. In addition, U.S. Pat. No. 5,564,503, which is commonly assigned with the present invention and is incorporated herein by reference, discloses several methods and systems for drilling and completing multilateral wells. Furthermore, U.S. Pat. Nos. 5,566,763 and 5,613,559, which are commonly assigned with the present invention and are incorporated herein by reference, both disclose decentralizing, centralizing, locating, and orienting apparatus and methods for multilateral well drilling and completion.

Notwithstanding the above-described efforts toward obtaining cost-effective and workable mutilateral well drilling and completions, a need still exists for improved apparatus and methods for precisely locating tools relative to a predetermined target depth in offshore, multilateral wells drilled from a floating drilling rig.

SUMMARY OF THE INVENTION

One aspect of the present invention comprises a temporary no-go assembly for use in locating a downhole tool at a predetermined target depth in a casing. The casing has a no-go shoulder. The temporary no-go assembly includes a no-go sleeve for interfacing with the no-go shoulder, and an actuating system for releasing the assembly from the no-go sleeve.

In this aspect of the present invention, the no-go sleeve may have a first slot formed therein. The assembly may also include a mandrel disposed within the no-go sleeve that has a second slot formed therein proximate the first slot. The actuating system may include an inner mandrel disposed within the mandrel. The inner mandrel has a first end with a first cross-sectional area and a second end with a second cross-sectional area smaller than the first cross-sectional area. The actuating system may further include a lug disposed within the first and second slots.

In another aspect, the present invention comprises a method of locating a downhole tool at a predetermined target depth in a well. A no-go shoulder is formed in a casing. A downhole tool, an anchoring system, and a temporary no-go assembly are coupled to a work string. The temporary no-go assembly includes a no-go sleeve for interfacing with the no-go shoulder, and an actuating system for releasing the assembly from the no-go sleeve. The work string is run into the casing until the no-go sleeve rests on the no-go shoulder.

In this aspect of the present invention, the no-go sleeve may have a first slot formed therein. The assembly may also include a mandrel disposed within the no-go sleeve that has a second slot formed therein proximate the first slot. The actuating system may include an inner mandrel disposed within the mandrel. The inner mandrel has a first end with a first cross-sectional area and a second end with a second cross-sectional area smaller than the first cross-sectional area. The actuating system may further include a lug disposed within the first and second slots.

In a further aspect, the present invention comprises a temporary no-go assembly for use in locating a downhole tool at a predetermined target depth in a casing. The casing has a landing nipple. The temporary no-go assembly includes a key for engaging the nipple, and a key retractor for retracting the key from the nipple.

In this aspect of the present invention, the assembly may also include a mandrel and an inner mandrel disposed within the mandrel. The inner mandrel has a first end with a first cross-sectional area and a second end with a second cross-sectional area smaller than the first cross-sectional area. The key retractor may be coupled to the inner mandrel, and the key may be disposed in the mandrel.

In a further aspect, the present invention comprises a method of locating a downhole tool at a predetermined target depth in a well. A landing nipple is formed in a casing. A downhole tool, an anchoring system, and a temporary no-go assembly are coupled to a work string. The temporary no-go assembly includes a key for engaging the nipple, and a key retractor for retracting the key form the nipple. The work string is run into the casing until the key engages the nipple.

In this aspect of the present invention, the assembly may also include a mandrel and an inner mandrel disposed within the mandrel. The inner mandrel has a first end with a first cross-sectional area and a second end with a second cross-sectional area smaller than the first cross-sectional area. The key retractor may be coupled to the inner mandrel, and the key may be disposed in the mandrel.

In a further aspect, the present invention comprises a temporary no-go assembly for use in locating a downhole tool at a predetermined target depth in a casing. The casing has a no-go shoulder. The temporary no-go assembly includes a key for interfacing with the no-go shoulder, and a key retractor for retracting the key from the no-go shoulder.

In this aspect of the present invention, the assembly may also include a mandrel and an inner mandrel disposed within the mandrel. The inner mandrel has a first end with a first cross-sectional area and a second end with a second cross-sectional area smaller than the first cross-sectional area. The key retractor may be coupled to the inner mandrel, and the key may be disposed in the mandrel.

In a further aspect, the present invention comprises a method of locating a downhole tool at a predetermined target depth in a well. A no-go shoulder is formed in a casing. A downhole tool, an anchoring system, and a temporary no-go assembly are coupled to a work string. The temporary no-go assembly includes a key for engaging the no-go shoulder, and a key retractor for retracting the key form the no-go shoulder. The work string is run into the casing until the key engages the no-go shoulder.

In this aspect of the present invention, the assembly may also include a mandrel and an inner mandrel disposed within the mandrel. The inner mandrel has a first end with a first cross-sectional area and a second end with a second cross-sectional area smaller than the first cross-sectional area. The key retractor may be coupled to the inner mandrel, and the key may be disposed in the mandrel.

BRIEF DESCRIPTION OF THE DRAWINGS

For a more complete understanding of the present invention and for further objects and advantages thereof, reference may now be had to the following description taken in conjunction with the accompanying drawings, in which.

DETAILED DESCRIPTION OF THE PREFERRED EMBODIMENTS

The preferred embodiments of the present invention and their advantages are best understood by referring to FIGS. 1–15 of the drawings, like numerals being used for like and corresponding parts of the various drawings.

Figure 3:
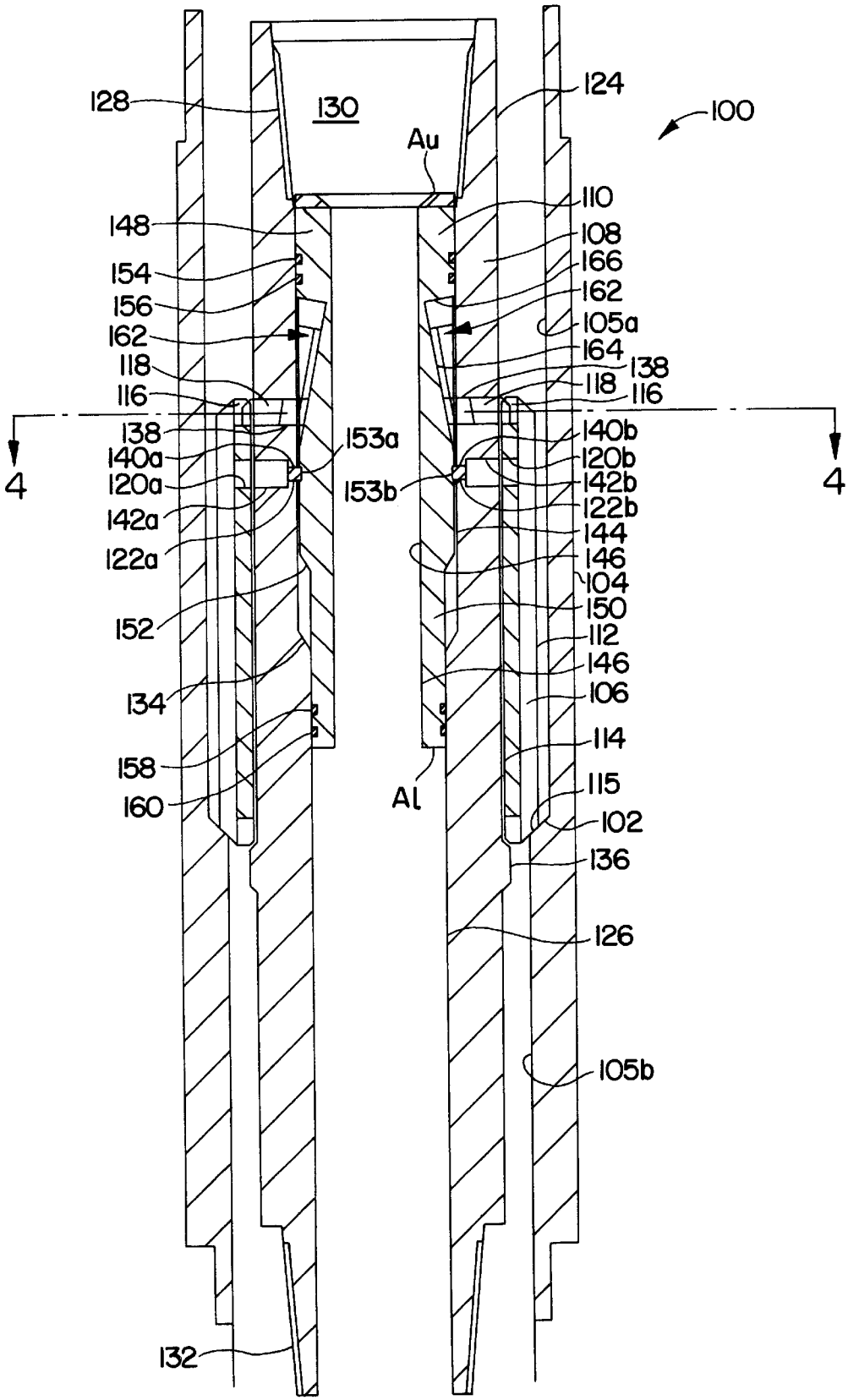
FIG. 3 is an enlarged, schematic, cross-sectional view of a temporary no-go assembly resting on a no-go shoulder within a main wellbore casing according to a first preferred embodiment of the present invention.
Figure 4:
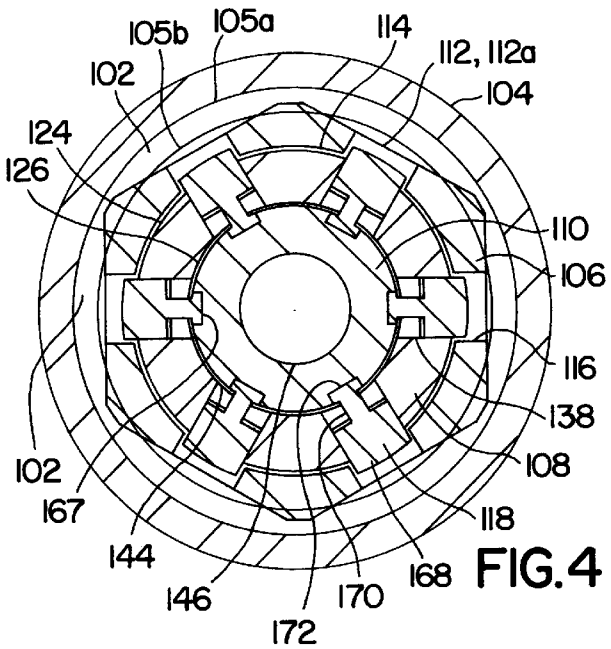
FIG. 4 is a top sectional view of FIG. 3 along line 4—4.

Referring first to FIGS. 3 and 4, a temporary no-go assembly 100 resting on a no-go shoulder 102 within a main wellbore casing 104 according to a first preferred embodiment of the present invention is illustrated. Above no-go shoulder 102, main wellbore casing 104 has an inner diameter 105*a*. Below no-go shoulder 102, main wellbore casing 104 has an inner diameter 105*b*, which is smaller than inner diameter 105*a*. No-go shoulder 102 is preferably conical.

Temporary no-go assembly 100 generally includes a no-go sleeve 106, a mandrel 108 disposed within no-go sleeve 106, and an inner mandrel 110 disposed within mandrel 108. No-go sleeve 106 preferably has an external surface 112, a generally cylindrical axial bore 114, and a conical bottom 115. Concial bottom 115 engages no-go shoulder 102 to prevent further downward movement of no-go sleeve 106 within main wellbore casing 104. As shown best in FIG. 4, external surface 112 preferably has a generally hexagonal geometry. Hexagonal external surface 112 may be formed by machining flats 112*a* on a generally cylindrical surface. Flats 112*a* do not fully engage the inner wall of casing 104 at inner diameter 105*a*, allowing fluid to bypass no-go sleeve 106 when it is resting on no-go shoulder 102. Of course, although not shown in FIGS. 3 and 4, external surface 112 may alternatively have a cylindrical or other polygonal geometry. Axial bore 114 is preferably lined with a conventional wear resistant material such as bronze to prevent galling against mandrel 108 or, as is explained in greater detail hereinbelow, a work string supporting a downhole tool.

No-go sleeve 106 also includes slots 116 that are preferably formed proximate its upper end and that are preferably evenly spaced around its circumference. Slots 116 open to axial bore 114. Slots 116 have a geometry designed to receive lugs 118. When external surface 112 has a generally hexagonal shape, one of slots 116 are preferably formed on each of flats 112*a*. No-go sleeve 106 also includes transverse ports 120*a* and 120*b* for providing access to shear pins 122*a* and 122*b*.

Mandrel 108 preferably has a generally cylindrical external surface 124 and a generally cylindrical axial bore 126. Mandrel 108 has threads 128 on its upper end for removably engaging with a tool joint 130. Tool joint 130 couples mandrel 108 to an upper portion of a work string (not shown) in the conventional manner. Mandrel 108 also has threads 132 on its lower end for removably engaging with a tool joint in a lower portion of a work string (not shown) in the conventional manner. Mandrel 108 has an annular shoulder 134 on axial bore 126. Mandrel 108 has a annular shoulder 136 on external surface 124 for supporting no-go sleeve 106 as temporary no-go assembly 100 travels through main wellbore casing 104, and for removing no-go sleeve 106 after it has been released from temporary no-go assembly 100, as is described hereinbelow.

Mandrel 108 also includes slots 138 for receiving lugs 118. Slots 138 are located around the circumference of mandrel 108 so as to cooperate with slots 116 of no-go sleeve 106. Mandrel 108 includes threaded ports 140*a* and 140*b* for engaging shear pins 122*a* and 122*b*, and mandrel 108 also includes transverse ports 142*a* and 142*b* for providing access to shear pins 122*a* and 122*b*.

Inner mandrel 110 preferably has a generally cylindrical external surface 144 and a cylindrical axial bore 146. External surface 144 has an upper portion 148 and a lower portion 150 having a smaller outer diameter than the outer diameter of upper portion 148. Therefore, upper portion 148 has a larger cross-sectional area $A_u$ than a cross-sectional area $A_l$ of lower portion 150. An annular shoulder 152, which is for mating with annular shoulder 134 of mandrel 108, divides upper portion 148 and lower portion 150. Inner mandrel 110 includes threaded ports 153*a* and 153*b* for engaging shear pins 122*a* and 122*b*. O-rings 154 and 156 fluidly seal inner mandrel 110 to axial bore 126 of mandrel 108, and o-rings 158 and 160 fluidly seal inner mandrel 110 to axial bore 126 of mandrel 108.

Inner mandrel 110 has lug recesses 162 for receiving lugs 118. Lug recesses 162 are located around the circumference of inner mandrel 110 so as to cooperate with slots 116 of no-go sleeve 106 and slots 138 of mandrel 108. Each of recesses 162 includes a cam surface 164 running from slot 138 to a stop 166. As shown best in FIG. 4, cam surface 164 includes a T slot or dovetail groove 167 running from slot 138 to stop 166. Each of lugs 118 includes a head 168, a retaining web 170 extending radially inward from head 168, and a flange 172 located on the end of retaining web 170 opposite head 168. Flange 172 is slidably engaged within T slot 167 along cam surface 164.

Figure 6:
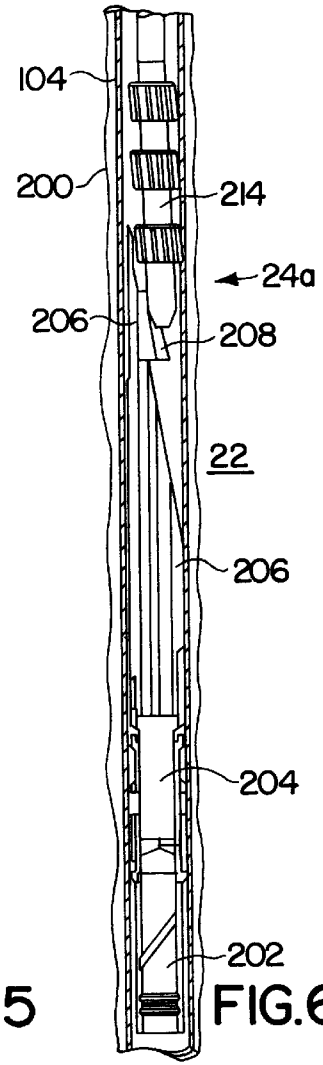
FIG. 6 is a schematic, cross-sectional view of the main wellbore of FIG. 5 showing a starter mill used to form a window in the main wellbore casing.
Figure 5:
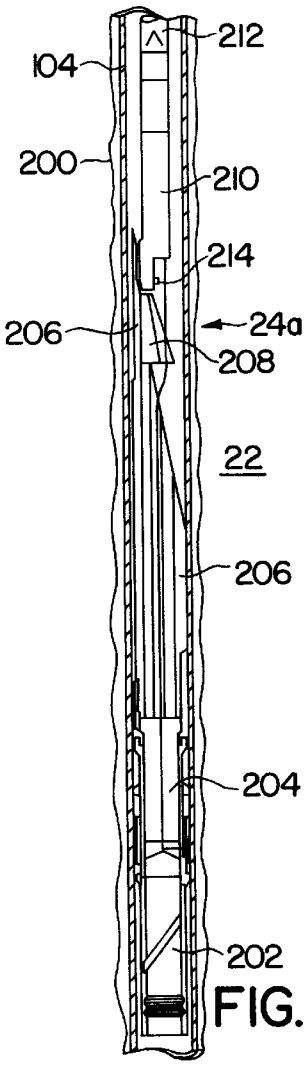
FIG. 5 is a schematic, cross-sectional view of a main wellbore in a multilateral well showing a packer, hollow whipstock, starter mill pilot lug, and associated structures used for drilling a lateral wellbore from the main wellbore and that may be precisely located relative to a predetermined target depth using the temporary no-go assembly of the present invention.
Figure 8:
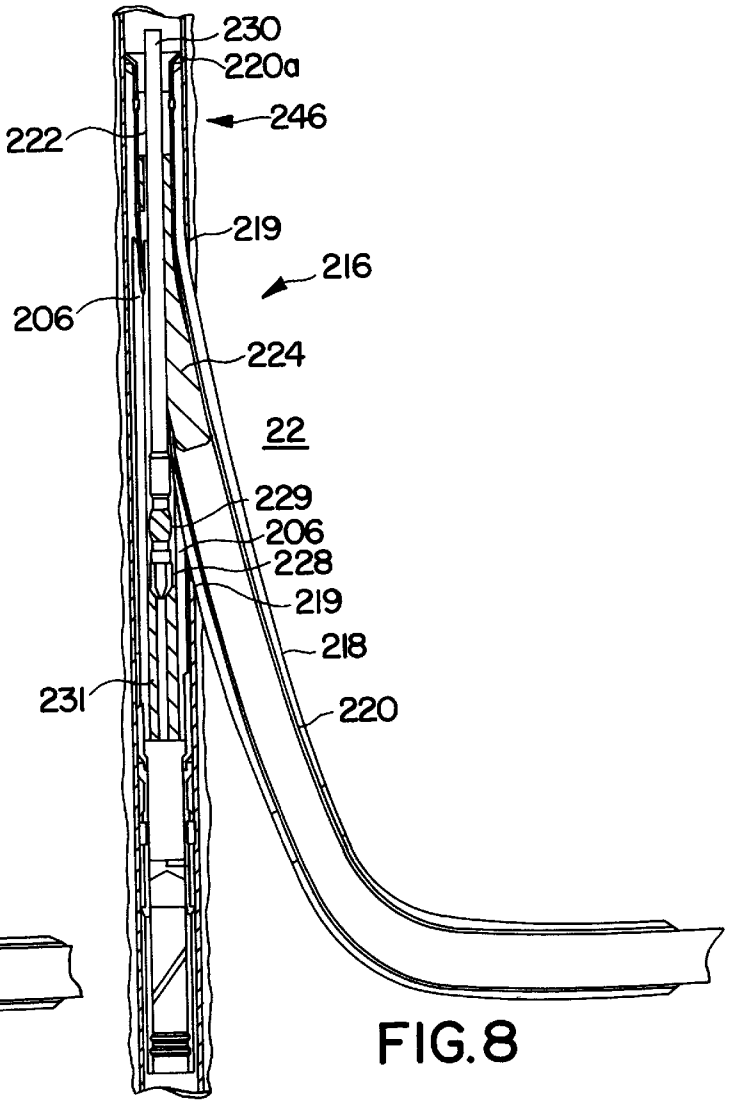
FIG. 8 is a schematic, cross-sectional view of the junction of FIG. 7 showing the drilling of the hollow whipstock in order to reopen a fluid communicating passage through the main wellbore.
Figure 7:
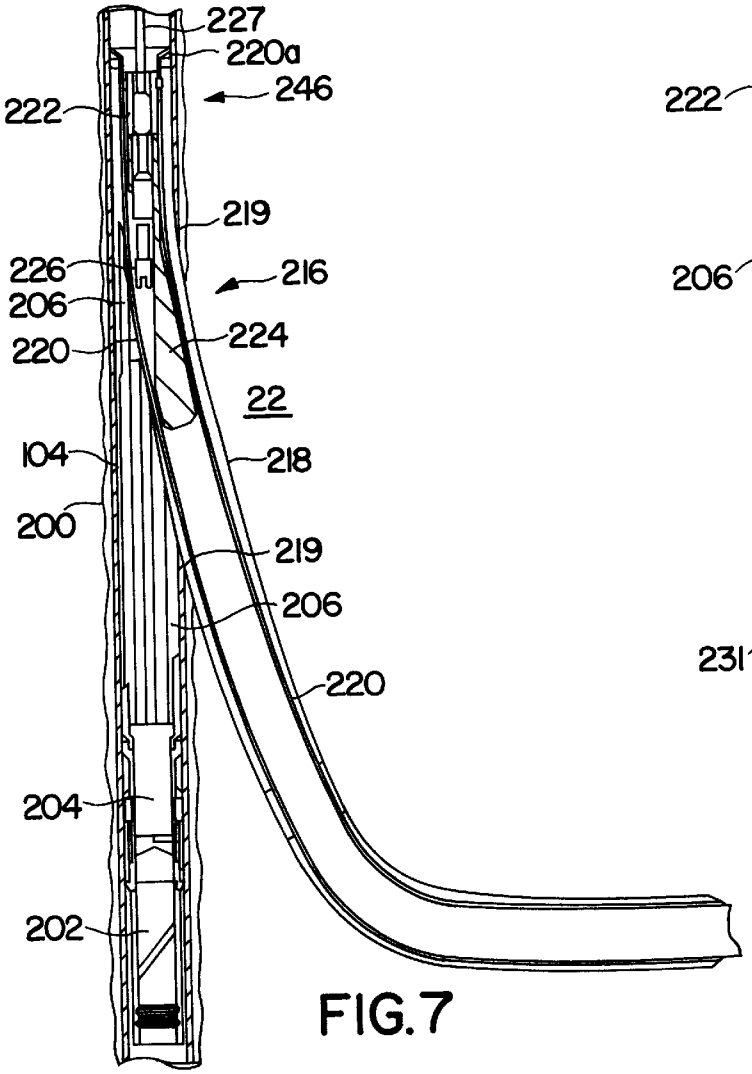
FIG. 7 is a schematic, cross-sectional view of a junction between the main wellbore and a lateral wellbore in a multilateral well showing a mill anchor, mill guide, and mill used for completing the junction and that may be precisely located relative to a predetermined target depth using the temporary no-go assembly of the present invention.

As described hereinabove, a specific need exists in the petroleum industry for precision locating of downhole tools relative to a predetermined target depth in offshore wells, and particularly in offshore, multilateral wells, drilled from floater 10. FIGS. 5 and 6 illustrate one such need, the precision locating of a packer, hollow whipstock, and starter mill pilot lug used for drilling a lateral wellbore from a main wellbore in a multilateral well drilled from floater 10. FIGS. 7 and 8 illustrate a second such need, the precision locating of a mill anchor, mill guide, and mill used during the completion of the junction between a lateral wellbore and a main wellbore in a multilateral well drilled from floater 10.

In the overall process of drilling and completing a lateral in a multilateral well from a floater 10, one of the steps involved is creating a window in the main wellbore casing 104 at a particular target depth 24*a*. Referring to FIG. 5, a portion of main wellbore casing 104 installed in main wellbore 200 within ocean floor 22 is illustrated. It is desired to create a window in main wellbore casing 104 at target depth 24*a* from which a lateral wellbore (not shown) may be drilled and completed. Therefore, an orientation nipple 202, a packer 204, a hollow whipstock 206, and a starter mill pilot lug 208 are coupled together and run into main wellbore casing 104 using a hollow whipstock running tool 210 and orientation sub 212 coupled to a work string (not shown). Certain portions of such a work string are disclosed in U.S. Pat. Nos. 5,613,559; 5,566,763; and 5,501,281, which are commonly assigned with the present invention and are incorporated herein by reference. Once pilot lug 208 is precisely located at target depth 24*a*, packer 204 is set, work string 16 is pulled upward to shear shear stud 214, and running tool 210 and orientation sub 212 are removed from main wellbore casing 104. Then, as shown in FIG. 6, a starter mill 214 is run into main wellbore casing 104 until it contacts pilot lug 208. Pilot lug 208 forces mill 214 radially outward so as to cut a window within main wellbore casing 104 at target depth 24*a*.

During the completion of a lateral drilled in main wellbore casing 104, one of the steps is to reestablish fluid communication through main wellbore casing 104 after a liner has been installed into the lateral wellbore and cemented into place. Referring to FIG. 7, a junction 216 between main wellbore 200 and a lateral wellbore 218 in a multilateral well drilled in ocean floor 22 is illustrated. A window 219 has been cut in main wellbore casing 104 as described hereinabove. After the drilling of lateral wellbore 218 using a series of mills and hollow whipstock 206, a liner 220 has been installed in lateral wellbore 218 and cemented into place. However, liner 220 extends into main wellbore casing 104 up to a point 220*a*, and residual cement (not shown) may exist within this portion of liner 220. Therefore, a mill anchor 222, a mill guide 224, and a skirted mill 226 are run into liner 220 using a work string 227. Once mill anchor 222 and mill guide 224 are precisely located at target depth 24*b*, mill anchor 222 is set against an inner wall of liner 220, and skirted mill 226 is used to initiate the milling of liner 220. Work string 227 is then pulled top hole. Next, as shown in FIG. 8, a milling assembly consisting of mills 228 and 229 is then run into mill anchor 222 and mill guide 224 using work string 230. Mills 228 and 229 are used to drill completely through liner 220, any residual cement, and an internal portion 231 of hollow whipstock 206. If mill anchor 222 and mill guide 224 are precisely located, fluid communication can thus be reestablished within main wellbore casing 104 without damaging any surrounding structure within junction 216.

As will be appreciated by one skilled in the art, precision locating of pilot lug 208 at target depth 24*a*, and precision locating of mill anchor 222 and mill guide 224 at target depth 24*b*, are critical to the success of the above-described multilateral drilling and completion operations. However, as described hereinabove, such precision locating is extremely difficult using conventional techniques when the multilateral well is drilled from floater 10.

Temporary no-go assembly 100 may be easily used to provide such precision location. Referring to FIGS. 3, 4, 5, and 6 in combination, temporary no-go assembly 100 may be coupled preferably via threads 128 to an upper portion of the work string 212 a lower portion of the work string having orientation nipple 202, packer 204, hollow whipstock 206, pilot lug 208, running tool 210, and orientation sub 212, may be coupled to the assembly 100, preferably via threads 132. The depth of no-go shoulder 102, and thus the relative distance between no-go shoulder 102 and target depth 24*a*, are known. Therefore, the work string may be formed so that pilot lug 208 is positioned at target depth 24*a* when no-go sleeve 106 is resting on no-go shoulder 102 above target depth 24*a*. Packer 204 is preferably a packer which is initially hydraulically set with a relatively low pressure, and is then fully set with a relatively high mechanical force created by transferring weight from the rig hoist system supporting the work string and/or additional hydraulic pressure. It will be understood by those skilled in the art that in some circumstances and with some specialized tools the temporary no-go assembly 100 may be coupled on the work string below the specialized tool.

When no-go sleeve 106 is resting on no-go shoulder 102, the following steps are preferably performed to precisely locate pilot lug 208 at target depth 24*a*. First, using conventional techniques, the work string, no-go sleeve 106, and pilot lug 208 are oriented to the desired relationship with the high side of main wellbore 200 by orientation sub 212 and a wire-line survey tool or work string conveyed measurement while drilling (MWD) tool. Second, some work string weight is used to cause no-go sleeve 106 to bear down on no-go shoulder 102, such as, by way of example, releasing tension in the conventional rig hoist system on semi-submersible 14 supporting the work string. This transfer of work string weight positively locates temporary no-go assembly 100 axially and rotationally. This transfer of work string weight also loads lugs 118, and as lugs 118 are received within slots 138 of mandrel 108 and slots 116 of no-go sleeve 106, no-go sleeve 106, mandrel 108, and inner mandrel 110 are prevented from moving axially or rotationally relative to one another. Third, the orientation of the work string and thus pilot lug 208 within main wellbore casing 104 are verified to be within a specified range. Fourth, the work string is pressured up so as to perform the initial setting of packer 204. The pressure necessary to perform this initial setting is preferably low enough so as to minimize or eliminate any "ballooning effect" and/or stretching of the work string below no-go shoulder 102. Fifth, the pressure in the work string is increased, and a pressure differential created by the varying cross-sectional areas $A_u$ and $A_l$ of inner mandrel 110 causes inner mandrel 110 to begin sliding downward within mandrel 108. As inner mandrel 110 begins to slide downward, shear pins 122*a* and 122*b* are sheared, and cam surfaces 164 of lug recesses 162 cause lugs 118 to be retracted from slots 116 in no-go sleeve 106. When lugs 118 are fully retracted, annular shoulder 152 of inner mandrel 110 rests against annular shoulder 134 of mandrel 108, and lugs 118 are unloaded. Sixth, additional work string weight is transferred from the rig hoist system to fully set packer 204. As will be appreciated by one skilled in the art, such weight is transmitted through mandrel 108, past no-go shoulder 102, and eventually to packer 204 because of the retraction and unloading of lugs 118. Alternatively, if packer 204 is solely hydraulically set, the work string may be pressured up to a point where lugs 118 are retracted and packer 204 is fully set in a single step.

As will also be appreciated by one skilled in the art, the work string weight transferred to no-go sleeve 106 may be removed after packer 204 is initially set, but before lugs 118 are retracted, if desired. As will further be appreciated by one skilled in the art, the orientation of inner mandrel 110, and the associate structure of mandrel 108, may be reversed or turned "upside down" from the orientation shown in FIG. 3. Therefore, upon appropriate pressurization of the work string, inner mandrel 110 may slide upward, instead of downward, within mandrel 108 so as to retract and unload lugs 118.

Figure 1:
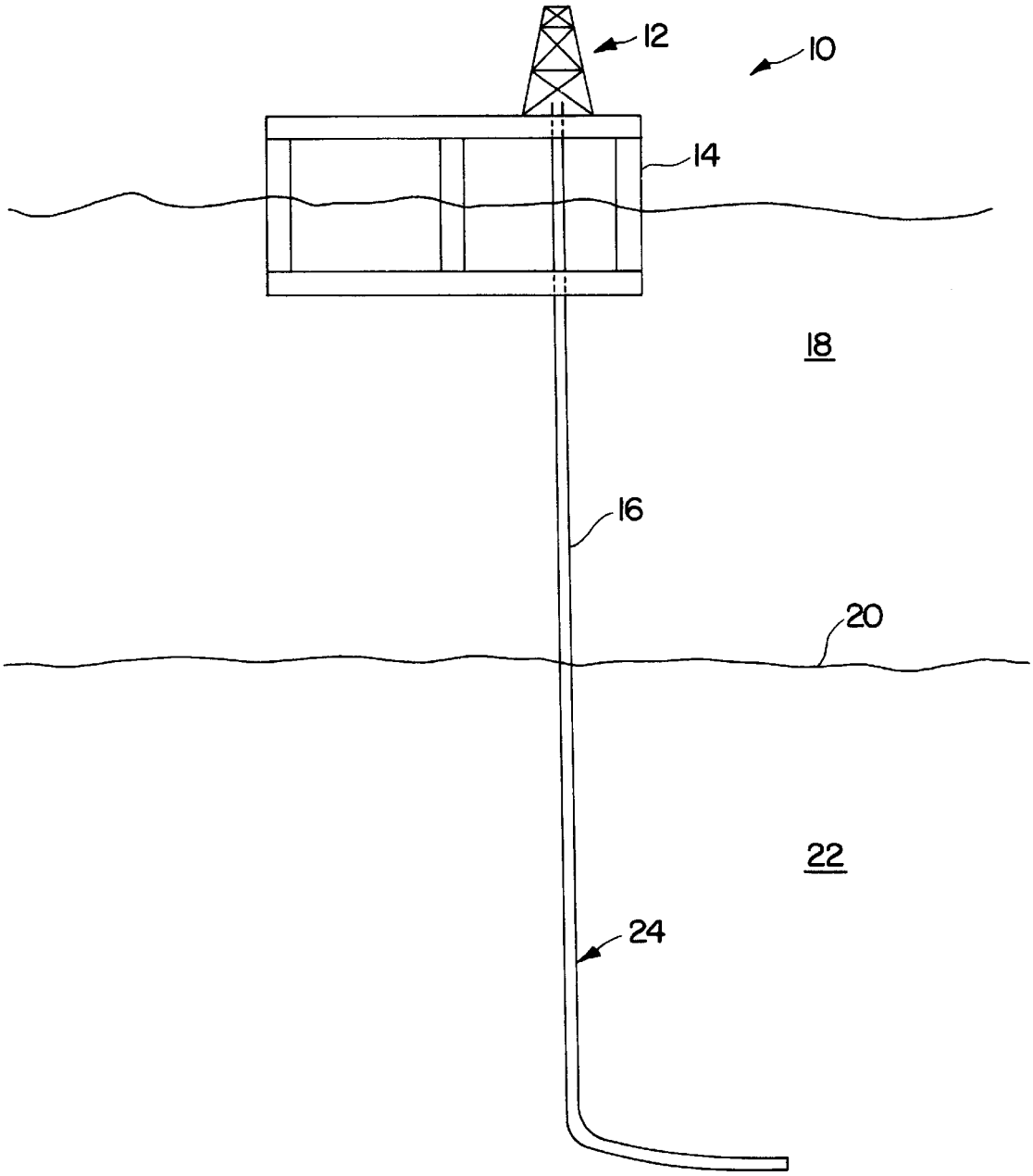
FIG. 1 PRIOR ART
FIG. 1 is a schematic illustration of a conventional floating drilling rig.
Figure 2:
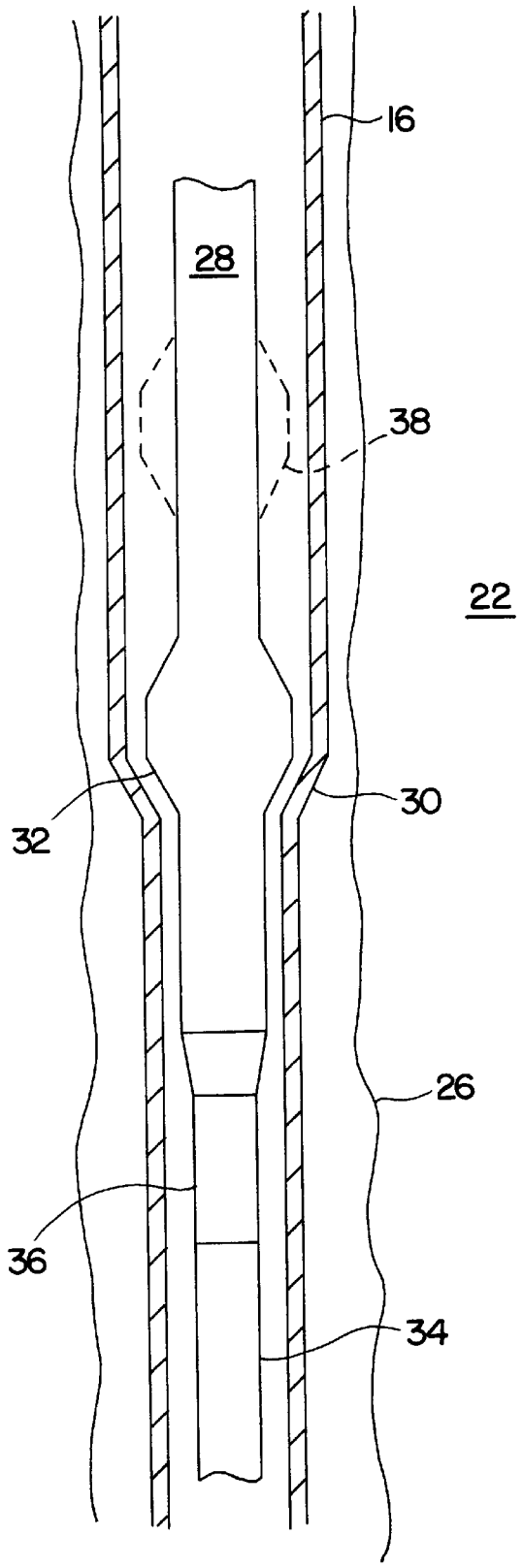
FIG. 2 PRIOR ART
FIG. 2 is an enlarged, schematic, cross-sectional view of a conventional no-go shoulder and sleeve utilized in connection with the conventional floating drilling rig of FIG. 1.

Significantly, unlike conventional fixed no-go sleeve 32 of FIG. 2, it is not necessary to lift temporary no-go assembly 100 above no-go shoulder 102 so as to fully set packer 204. Therefore, temporary no-go assembly 100 avoids the inaccuracies associated with such lifting that would endanger the successful milling of a window in main wellbore casing 104 exactly at target depth 24*a*. In addition, unlike conventional fixed no-go sleeve 32 of FIG. 2, the work string may be moved downhole past no-go shoulder 102 without bringing the work string top hole to remove temporary no-go assembly 100. The ability to not have to remove temporary no-go assembly 100 allows milling or other downhole operations to proceed and minimizes the number of work string trips into the well.

Referring now to FIGS. 3, 4, 7, and 8 in combination, temporary no-go assembly 100 may be coupled preferably via threads 128 to an upper portion of the work string 227. A lower portion of the work string 227 having mill anchor 222 and mill guide 224, may be coupled to the assembly 100, preferably via threads 132. The depth of no-go shoulder 102, and thus the relative distance between no-go shoulder 102 and target depth 24*b*, are known. Therefore, the work string may be formed so that mill anchor 222 is positioned at target depth 24*b* above temporary no-go assembly 100 when no-go sleeve 106 is resting on no-go shoulder 102.

Mill anchor 222 is preferably initially hydraulically set with a relatively low pressure, and is then fully set with a relatively high mechanical force created by transferring weight from the rig hoist system supporting the work string. Alternatively, mill anchor may be solely hydraulically set. Therefore, using procedures substantially identical to the procedures described above in connection with pilot lug 208, temporary no-go assembly 100 may be used to precisely locate mill anchor 222 exactly at target depth 24*b*, without the above-described disadvantages of conventional fixed no-go sleeve 32 of FIG. 2.

Figure 9:
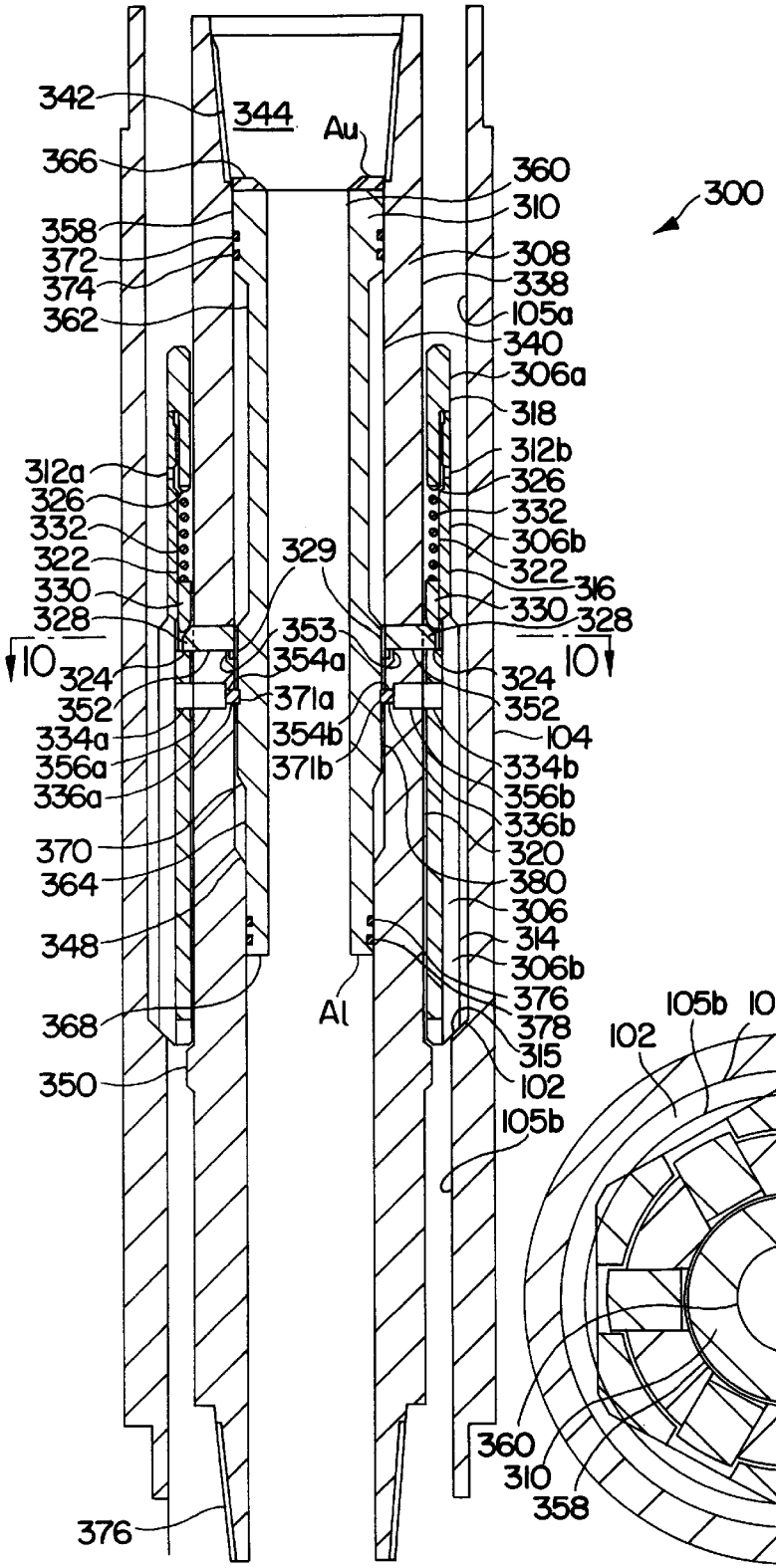
FIG. 9 is an enlarged, schematic, cross-sectional view of a temporary no-go assembly resting on a no-go shoulder within a main wellbore casing according to a second preferred embodiment of the present invention.
Figure 10:
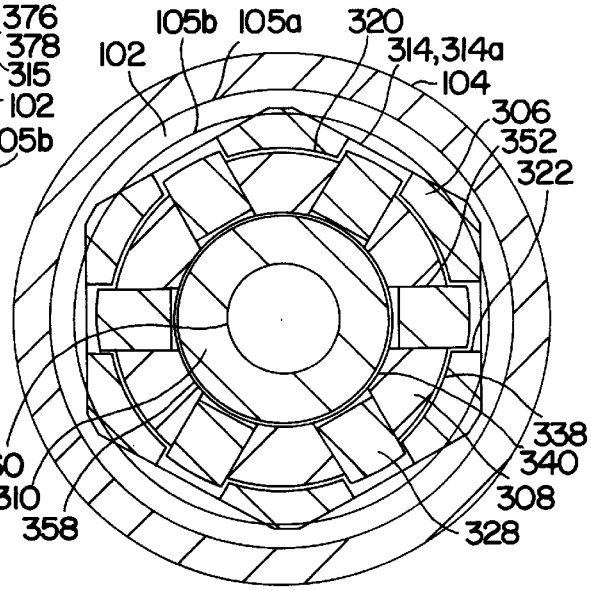
FIG. 10 is a top sectional view of FIG. 9 along line 10—10.

Referring to FIGS. 9 and 10, a temporary no-go assembly 300 resting on no-go shoulder 102 within main wellbore casing 104 according to a second preferred embodiment of the present invention is illustrated. Temporary no-go assembly 300 generally includes a no-go sleeve 306, a mandrel 308 disposed within no-go sleeve 306, and an inner mandrel 310 disposed within mandrel 308.

No-go sleeve 306 preferably has an upper portion 306*a* and a lower portion 306*b* that are preferably connected via screws 312*a* and 312*b*. Upper portion 306*a* has a generally cylindrical external surface 318. Lower portion 306*b* has a generally cylindrical external surface 316 on its upper end, near upper portion 306*a*. As shown best in FIG. 10, lower portion 306*b* preferably has an external surface 314 with a generally hexagonal geometry on its lower end. Hexagonal external surface 314 may be formed by machining flats 314*a* on a generally cylindrical surface. Lower portion 306*b* also has a generally conical bottom 315. Conical bottom 315 engages no-go shoulder 102 to prevent further downward movement of no-go sleeve 306 within main wellbore casing 104. Flats 314*a* do not fully engage the inner wall of casing 104 at inner diameter 105*a*, allowing fluid to bypass no-go sleeve 306 when it is resting on no-go shoulder 102. Of course, although not shown in FIGS. 9 and 10, external surface 314 may alternatively have a cylindrical or other polygonal geometry.

No go-sleeve 306 preferably has a generally cylindrical axial bore 320. Axial bore 320 is preferably lined with a conventional wear resistant material such as bronze to prevent galling with mandrel 308 or a work string supporting a downhole tool.

No-go sleeve 306 also includes slots 322 that are preferably evenly spaced around its circumference. Each of slots 322 preferably extends from a shoulder 324 of lower portion 306*b* to a spring retaining end 326 of upper portion 306*a*. Each of slots 322 opens to axial bore 320 but preferably does not extend through to external surfaces 314 or 316. Each of slots 322 has a geometry designed to receive a lug 328, a lower spring retaining member 330 that abuts an upper surface of lug 328, and a spring 332 disposed between spring retaining end 326 and spring retaining member 330. Spring 332 is disposed between spring retaining end 326 and spring retaining member 330 in compression. When external surface 314 has a generally hexagonal shape, one of slots 322 are preferably formed on each of flats 314*a*. No-go sleeve 106 also includes transverse ports 334*a* and 334*b*, which are preferably located in lower portion 306*b*, for providing access to shear pins 336*a* and 336*b*.

Mandrel 308 preferably has a generally cylindrical external surface 338 and a generally cylindrical axial bore 340. Mandrel 308 has threads 342 on its upper end for removably engaging with a tool joint 344. Tool joint 344 couples mandrel 308 to an upper portion of a work string (not shown) in the conventional manner. Mandrel 308 also has threads 346 on its lower end for removably engaging with a tool joint in a lower portion of a work string (not shown) in the conventional manner. Mandrel 308 has an annular shoulder 348 on axial bore 340. Mandrel 308 has a annular shoulder 350 on external surface 338 for supporting no-go sleeve 306 as temporary no-go assembly 300 travels through main wellbore casing 104, and for removing no-go sleeve 306 after it has been released from temporary no-go assembly 300, as is described hereinbelow.

Mandrel 308 also includes slots 352 for receiving lugs 328. Slots 352 are located around the circumference of mandrel 308 so as to cooperate with slots 322 of no-go sleeve 306. Each of slots 352 preferably includes a shoulder 353 proximate axial bore 340 for mating with a retaining lip 329 on each of lugs 328. Mandrel 308 includes threaded ports 354*a* and 354*b* for engaging shear pins 336*a* and 336*b*, and mandrel 308 also includes transverse ports 356*a* and 356*b* for providing access to shear pins 336*a* and 336*b*.

Inner mandrel 310 preferably has a generally cylindrical external surface 358 and a cylindrical axial bore 360. External surface 358 has an upper annular recess 362 and a lower annular recess 364 formed therein. Inner mandrel 310 has a larger cross-sectional area $A_u$ at an upper end 366 than a cross-sectional area $A_l$ at a lower end 368. External surface 358 also has an annular shoulder 370 located proximate an upper end of annular recess 364 for mating with annular shoulder 348 of mandrel 308. External surface 358 further has a contacting area 380, defined by annular recesses 362 and 364. Contacting area 380 is for abutting against lugs 328. Inner mandrel 310 includes ports 371*a* and 371*b* for engaging shear pins 336*a* and 336*b*. O-rings 372 and 374 fluidly seal inner mandrel 310 to axial bore 340 of mandrel 308, and o-rings 376 and 378 fluidly seal inner mandrel 310 to axial bore 340 of mandrel 308.

Referring to FIGS. 5, 6, 9, and 10 in combination, temporary no-go assembly 300 may be coupled preferably via threads 342 to an upper portion of the work string 212. A lower portion of the work string having orientation nipple 202, packer 204, hollow whipstock 206, pilot lug 208, running tool 210, and orientation sub 212, may be coupled to the assembly 100, preferably via threads 346. The depth of no-go shoulder 102, and thus the relative distance between no-go shoulder 102 and target depth 24*a*, are known. Therefore, the work string may be formed so that pilot lug 208 is positioned at target depth 24*a* when no-go sleeve 306 is resting on no-go shoulder 102 above target depth 24*a*. Packer 204 is preferably a packer which is initially hydraulically set with a relatively low pressure, and is then fully set with a relatively high mechanical force created by transferring weight from the rig hoist system supporting the work string and/or additional hydraulic pressure.

When no-go sleeve 306 is resting on no-go shoulder 102, the following steps are preferably performed to precisely locate pilot lug 208 at target depth 24*a*. First, using conventional techniques, the work string, no-go sleeve 306, and pilot lug 208 are oriented to the desired relationship with the high side of main wellbore 200 by orientation sub 212 and a wire-line survey tool or work string conveyed MWD tool. Second, some work string weight is used to cause no-go sleeve 306 to bear down on no-go shoulder 102, such as, by way of example, releasing tension in the conventional rig hoist system on semi-submersible 14 supporting the work string. This transfer of work string weight positively locates temporary no-go assembly 300 axially and rotationally. This transfer of work string weight also loads lugs 328, and as lugs 328 are received within slots 352 of mandrel 308 and slots 322 of no-go sleeve 306, no-go sleeve 306, mandrel 308, and inner mandrel 310 are prevented from moving axially or rotationally relative to one another. Third, the orientation of the work string and thus pilot lug 208 within main wellbore casing 104 are verified to be within a specified range. Fourth, the work string is pressured up so as to perform the initial setting of packer 204. The pressure necessary to perform this initial setting is preferably low enough so as to minimize or eliminate any "ballooning effect" and/or stretching of the work string below no-go shoulder 102. Fifth, the pressure in the work string is increased, and a pressure differential created by the varying cross-sectional areas $A_u$ and $A_l$ of inner mandrel 310 causes inner mandrel 310 to begin sliding downward within mandrel 308. As inner mandrel 310 begins to slide downward, shear pins 336*a* and 336*b* are sheared. At the same time, contacting area 380 moves downward, so that annular recess 362 is opposite lugs 328, and annular shoulder 370 of inner mandrel 310 rests against annular shoulder 348 of mandrel 308. However, lugs 328 remain engaged within slots 352 of mandrel 308 and slots 322 of no-go sleeve 306 due to work string weight on no-go sleeve 306. Sixth, some of the work string weight on no-go sleeve 306 is removed by increasing the tension on the rig hoist system. This decrease in work string weight on no-go sleeve 306 is preferably performed gradually so as to slowly unload lugs 328. As lugs 328 are unloaded, springs 332 force spring retaining members 330 downward, and spring retaining members 330 force lugs 328 radially inward and out of slots 322 in no-go sleeve 306. Seventh, additional work string weight is transferred from the rig hoist system to fully set packer 204. As will be appreciated by one skilled in the art, such weight is transmitted through mandrel 308, past no-go shoulder 102, and eventually to packer 204 because of the removal of lugs 328 from slots 322.

As will also be appreciated by one skilled in the art, the work string may be pressurized to slide inner mandrel 310 downward before the initial setting of packer 204, if desired. As will further be appreciated by one skilled in the art, the orientation of inner mandrel 310, and the associated structure of mandrel 308, may be reversed or turned "upside down" from the orientation shown in FIG. 3. Therefore, upon appropriate pressurization of the work string, inner mandrel 310 may slide upward, instead of downward, within mandrel 308.

Significantly, unlike conventional fixed no-go sleeve 32 of FIG. 2, it is not necessary to lift temporary no-go assembly 300 above no-go shoulder 102 so as to fully set packer 204. Therefore, temporary no-go assembly 300 avoids the inaccuracies associated with such lifting that would endanger the successful milling of a window in main wellbore casing 104 exactly at target depth 24*a*. In addition, unlike conventional fixed no-go sleeve 32 of FIG. 2, the work string may be moved downhole past no-go shoulder 102 without bringing the work string top hole to remove temporary no-go assembly 300. The ability to not have to remove temporary no-go assembly 300 allows milling or other downhole operations to proceed and minimizes the number of work string trips into the well. Furthermore, temporary no-go assembly 300 exhibits a more gradual unloading of lugs 328, as compared with the unloading of lugs 118 of temporary no-go assembly 100. It is believed that such gradual unloading of lugs 328 will be advantageous for certain downhole processes.

Referring now to FIGS. 7, 8, 9, and 10 in combination, temporary no-go assembly 300 may be coupled preferably via threads 342 to an upper portion of the work string 227. A lower portion of the work string 227 having mill anchor 222 and mill guide 224, may be coupled to the assembly 100, preferably via threads 346. The depth of no-go shoulder 102, and thus the relative distance between no-go shoulder 102 and target depth 24*b*, are known. Therefore, the work string may be formed so that mill anchor 222 is positioned at target depth 24*b* above temporary no-go assembly 100 when no-go sleeve 306 is resting on no-go shoulder 102.

Mill anchor 222 is preferably initially hydraulically set with a relatively low pressure, and is then fully set with a relatively high mechanical force created by transferring weight from the rig hoist system supporting the work string. Alternatively, mill anchor 222 may be solely hydraulically set. Therefore, using procedures substantially identical to the procedures described above in connection with pilot lug 208, temporary no-go assembly 300 may be used to precisely locate mill anchor 222 exactly at target depth 24*b*, without the above-described disadvantages of conventional fixed no-go sleeve 32 of FIG. 2.

Figure 11:
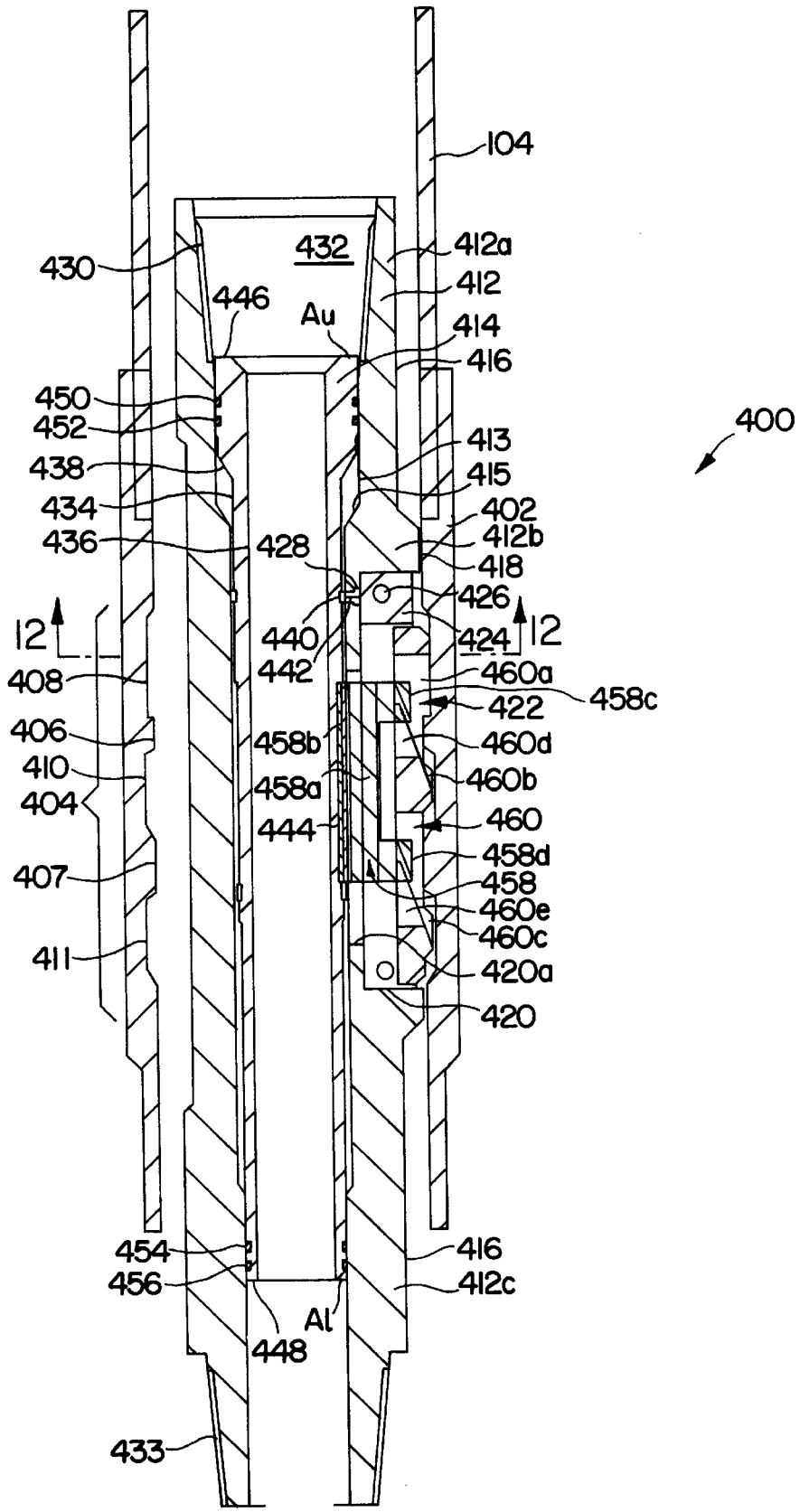
FIG. 11 is an enlarged, schematic, cross-sectional view of a temporary no-go assembly engaged with a landing nipple within a main wellbore casing according to a third preferred embodiment of the present invention.
Figure 12:
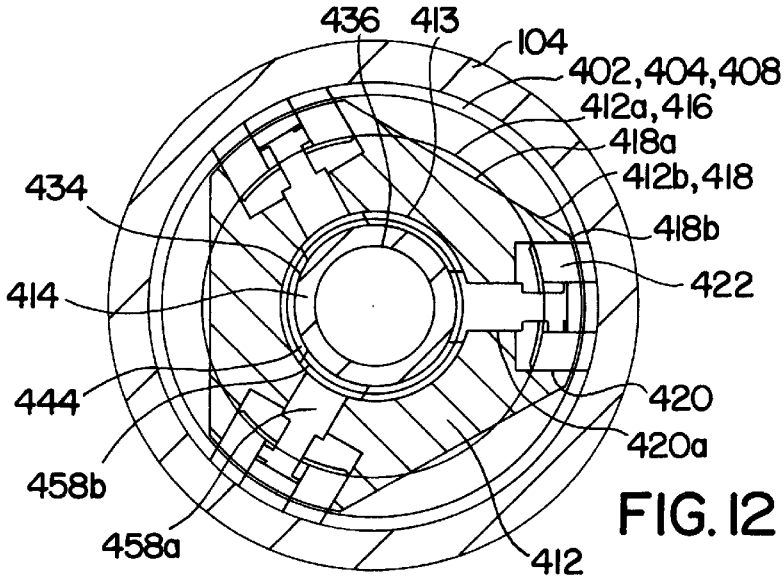
FIG. 12 is a top sectional view of FIG. 11 along line 12—12.
Figure 13A:
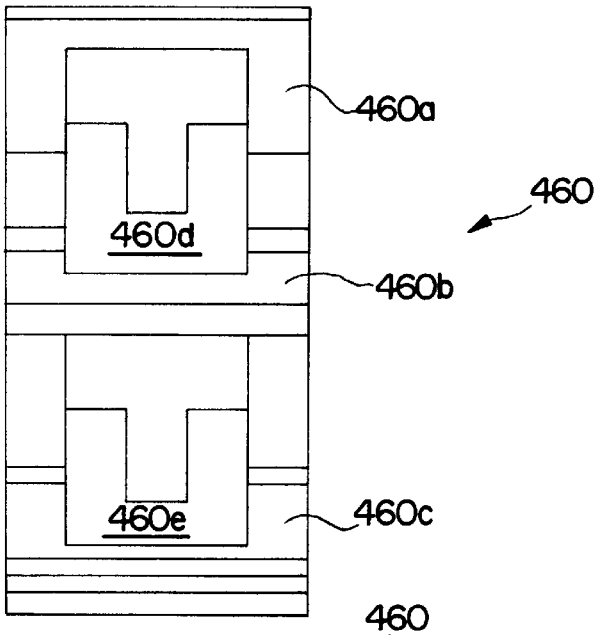
FIG. 13A is an enlarged, schematic, side view of the key of the temporary no-go assembly of FIG. 11.
Figure 13B:
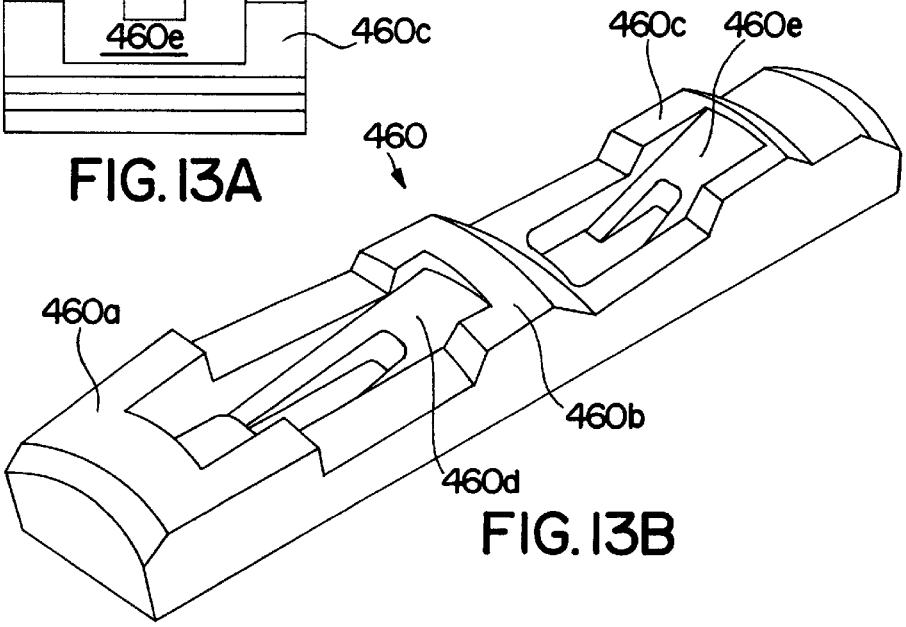
FIG. 13B is an enlarged, schematic, perspective view of the key of the temporary no-go assembly of FIG. 11.

Referring to FIGS. 11 and 12, a temporary no-go assembly 400 for interfacing with a landing nipple 402 within main wellbore casing 104 according to a third preferred embodiment of the present invention is illustrated. Nipple 402 preferably has a profile 404 that travels around the circumference of main wellbore casing 104. Profile 404 preferably includes a first shoulder 406 surrounded by first and second recesses 408 and 410, and a second shoulder 407 surrounded by second recess 410 and a third recess 411. Temporary no-go assembly 400 generally includes a mandrel 412 and an inner mandrel 414 disposed within mandrel 412.

Mandrel 412 preferably has a upper portion 412*a*, a central portion 412*b*, and a lower portion 412*c*. Each of portions 412*a*, 412*b*, and 412*c* have a generally cylindrical axial bore 413. Axial bore 413 has an annular shoulder 415. Upper portion 412*a* and lower portion 412*c* have a generally cylindrical external surface 416.

As shown best in FIG. 12, central portion 412*b* preferably has an external surface 418 with a generally triangular geometry. Triangular external surface 418 may be formed by machining flats 418*a* on a generally cylindrical surface. Flats 418*a* allow fluid to bypass temporary no-go assembly 400 when it is engaged with nipple 402. A plurality of slots 420 are formed in external surface 418, and a key assembly 422 and a spacer member 424 are disposed within each slot 420. Slots 420 are preferably formed in corners 418*b* of external surface 418. A threaded hole 426 within each spacer member 424 receives a threaded pin (not shown) to secure each spacer member 424 within its respective slot 420. As shown best in FIG. 12, each slot 420 includes a portion 420*a* extending through to axial bore 413. Each slot 420 also includes a threaded port 428 extending through to axial bore 413. Of course, external surface 418 may have a different polygonal geometry, with a different number of slots and key assemblies, than that shown in FIGS. 11 and 12.

Mandrel 412 has threads 430 on its upper end for removably engaging with a tool joint 432. Tool joint 432 couples mandrel 412 to an upper portion of a work string (not shown) in the conventional manner. Mandrel 412 also has threads 433 on its lower end for removably engaging with a tool joint in a lower portion of a work string (not shown) in the conventional manner.

Inner mandrel 414 preferably has a generally cylindrical external surface 434 and a cylindrical axial bore 436. External surface 434 has an annular shoulder 438 for mating with annular shoulder 415 of axial bore 413 of mandrel 412. External surface 434 also has ports 440. Ports 440 are preferably located around the circumference of inner mandrel 414 so as to cooperate with threaded ports 428 of slots 420. Shear pins 442 are removably disposed in threaded ports 440 and threaded ports 428. External surface 434 further has an annular recess 444 for receiving key assemblies 422. Annular recesses 444 are preferably located around the circumference of inner mandrel 414 so as to cooperate with portion 420*a* of slots 420. Upper end 446 of inner mandrel 414 has a larger cross-sectional area $A_u$ than a cross-sectional area $A_l$ of a lower end 448. O-rings 450 and 452 fluidly seal inner mandrel 414 to axial bore 413 of mandrel 412, and o-rings 454 and 456 fluidly seal inner mandrel 414 to axial bore 413 of mandrel 412.

As shown in FIGS. 11, 12, 13A, and 13B, each key assembly 422 generally includes a key retractor 458 and a key 460. Each key retractor 458 preferably has a retaining web portion 458*a* with a flange 458*b* received in annular recess 444 of inner mandrel 414. Each key retractor 458 also preferably has retractor arms 458*c* and 458*d*. Each key 460 preferably has teeth 460*a*, 460*b*, and 460*c* and cam surfaces 460*d* and 460*e*. Teeth 460*a–c* are designed to interface with profile 404 of nipple 402 of main wellbore casing 104. As shown in FIG. 11, teeth 460*a* support temporary no-go assembly 400 on shoulder 406 of profile 404. Cam surfaces 460*d* and 460*e* interface with retractor arms 458*c* and 458*d* of key retractor 458, respectively. Although not shown in FIG. 11, each key 460 is biased radially outwardly from slot 420 by a spring or springs, as is conventional. Alternatively, each key 460 may be biased radially outward from slot 420 by a hydraulic piston or pistons. Such hydraulic pistons may not be expanded until key assemblies 422 are proximate nipple 402, so as to prevent key assemblies 422 from riding on main wellbore casing 104. In addition, each key 460 may be formed from a spring steel, spring steel alloy, or other conventional spring material to facilitate the expansion and retraction of keys by the hydraulic pistons. Furthermore, each key 460 formed from a spring material may have a plurality of slots formed therein so as to optimize the spring force of the key. Of course, each key 460 may have a different number of teeth, and nipple 402 may be formed with a different profile 404, than shown in FIG. 11.

Referring to FIGS. 5, 6, 11, 12, 13A, and 13B in combination, temporary no-go assembly 400 may be coupled preferably via threads 430 to an upper portion of the work string 212. A lower portion of the work string having orientation nipple 202, packer 204, hollow whipstock 206, pilot lug 208, running tool 210, and orientation sub 212, may be coupled to the assembly 100, preferably via threads 433. The depth of nipple 402, and thus the relative distance between nipple 402 and target depth 24*a*, are known. Therefore, the work string may be formed so that pilot lug 208 is positioned at target depth 24*a* when key assemblies 422 are engaged in nipple 402 above target depth 24*a*. Packer 204 is preferably a packer which is initially hydraulically set with a relatively low pressure, and is then fully set with a relatively high mechanical force created by transferring weight from the rig hoist system supporting the work string and/or additional hydraulic pressure.

When key assemblies 422 are engaged in nipple 402, the following steps are preferably performed to precisely locate pilot lug 208 at target depth 24*a*. First, using conventional techniques, the work string, key assemblies 422, and pilot lug 208 are oriented to the desired relationship with the high side of main wellbore 200 by orientation sub 212 and a wire-line survey tool or work string conveyed MWD tool. Second, some work string weight is used to cause key assemblies 422 to bear down on nipple 402, such as, by way of example, releasing tension in the conventional rig hoist system on semi-submersible 14 supporting the work string. This transfer of work string weight positively locates temporary no-go assembly 400 axially and rotationally. More specifically, the transfer of work string weight causes teeth 460*a* to bear down on the upper end of shoulder 406 of profile 404, loading keys 460. Third, the orientation of the work string and thus pilot lug 208 within main wellbore casing 104 are verified to be within a specified range. Fourth, the work string is pressured up so as to perform the initial setting of packer 204. The pressure necessary to perform this initial setting is preferably low enough so as to minimize or eliminate any "ballooning effect" and/or stretching of the work string below nipple 402. Fifth, the pressure in the work string is increased, and a pressure differential created by the varying cross-sectional areas $A_u$ and $A_l$ of inner mandrel 414 causes inner mandrel 414 to begin sliding downward within mandrel 412. As inner mandrel 414 begins to slide downward, shear pins 442 are sheared, and key retractors 458 retract keys 460 from nipple 402. More specifically, cam surfaces 460*d* and 460*e* cooperate with retractor arms 458*c* and 458*d* so as to retract teeth 460*a–c* from recesses 408, 410, and 411. Keys 460 are now unloaded, and annular shoulder 438 of inner mandrel 414 rests against annular shoulder 415 of mandrel 412. Sixth, additional work string weight is transferred from the rig hoist system to fully set packer 204. As will be appreciated by one skilled in the art, such weight is transmitted through mandrel 412, past nipple 402, and eventually to packer 204 because of the retraction and unloading of keys 460. Alternatively, if packer 204 is solely hydraulically set, the work string may be pressured up to a point where key 460 is retracted and packer 204 is fully set in a single step.

As will also be appreciated by one skilled in the art, the work string weight transferred to key assemblies 422 may be removed after packer 204 is initially set, but before keys 460 are retracted, if desired. As will further be appreciated by one skilled in the art, the orientation of inner mandrel 414, the associated structure of mandrel 412, key retractors 458, and cam surfaces 460*d* and 460*e* may be reversed or turned "upside down" from the orientation shown in FIG. 11. Therefore, upon appropriate pressurization of the work string, inner mandrel 414 may slide upward, instead of downward, within mandrel 412 so as to retract and unload keys 460.

Significantly, unlike conventional fixed no-go sleeve 32 of FIG. 2, it is not necessary to lift temporary no-go assembly 400 above a shoulder within main wellbore casing 104 so as to fully set packer 204. Therefore, temporary no-go assembly 400 avoids the inaccuracies associated with such lifting that would endanger the successful milling of a window in main wellbore casing 104 exactly at target depth 24*a*. In addition, unlike conventional fixed no-go sleeve 32 of FIG. 2, the work string may be moved downhole past nipple 402 without bringing the work string top hole to remove temporary no-go assembly 400. The ability to not have to remove temporary no-go assembly 400 allows milling or other downhole operations to proceed and minimizes the number of work string trips into the well. Furthermore, in contrast to fixed no-go sleeve 32 and temporary no-go assemblies 100 and 300, temporary no-go assembly 400 does not require a narrowing of the inner diameter of main wellbore casing 104 due to a no-go shoulder. In downhole processes that require milling of main wellbore casing 104, or in downhole processes where inner casing diameter is critical, the lack of a no-go shoulder is especially advantageous.

Referring now to FIGS. 7, 8, 11, 12, 13A, and 13B in combination, temporary no-go assembly 400 may be coupled preferably via threads 430 to an upper portion of the work string 227. A lower portion of the work string 227 having mill anchor 222 and mill guide 224, may be coupled to the assembly 100, preferably via threads 433. The depth of nipple 402, and thus the relative distance between nipple 402 and target depth 24*b*, are known. Therefore, the work string may be formed so that mill anchor 222 is positioned at target depth 24*b* above temporary no-go assembly 100 when key assemblies 422 are engaged in nipple 402.

Mill anchor 222 is preferably initially hydraulically set with a relatively low pressure, and is then fully set with a relatively high mechanical force created by transferring weight from the rig hoist system supporting the work string. Alternatively, mill anchor may be solely hydraulically set. Therefore, using procedures substantially identical to the procedures described above in connection with pilot lug 208, temporary no-go assembly 400 may be used to precisely locate mill anchor 222 exactly at target depth 24*b*, without the above-described disadvantages of conventional fixed no-go sleeve 32 of FIG. 2.

Figure 14:
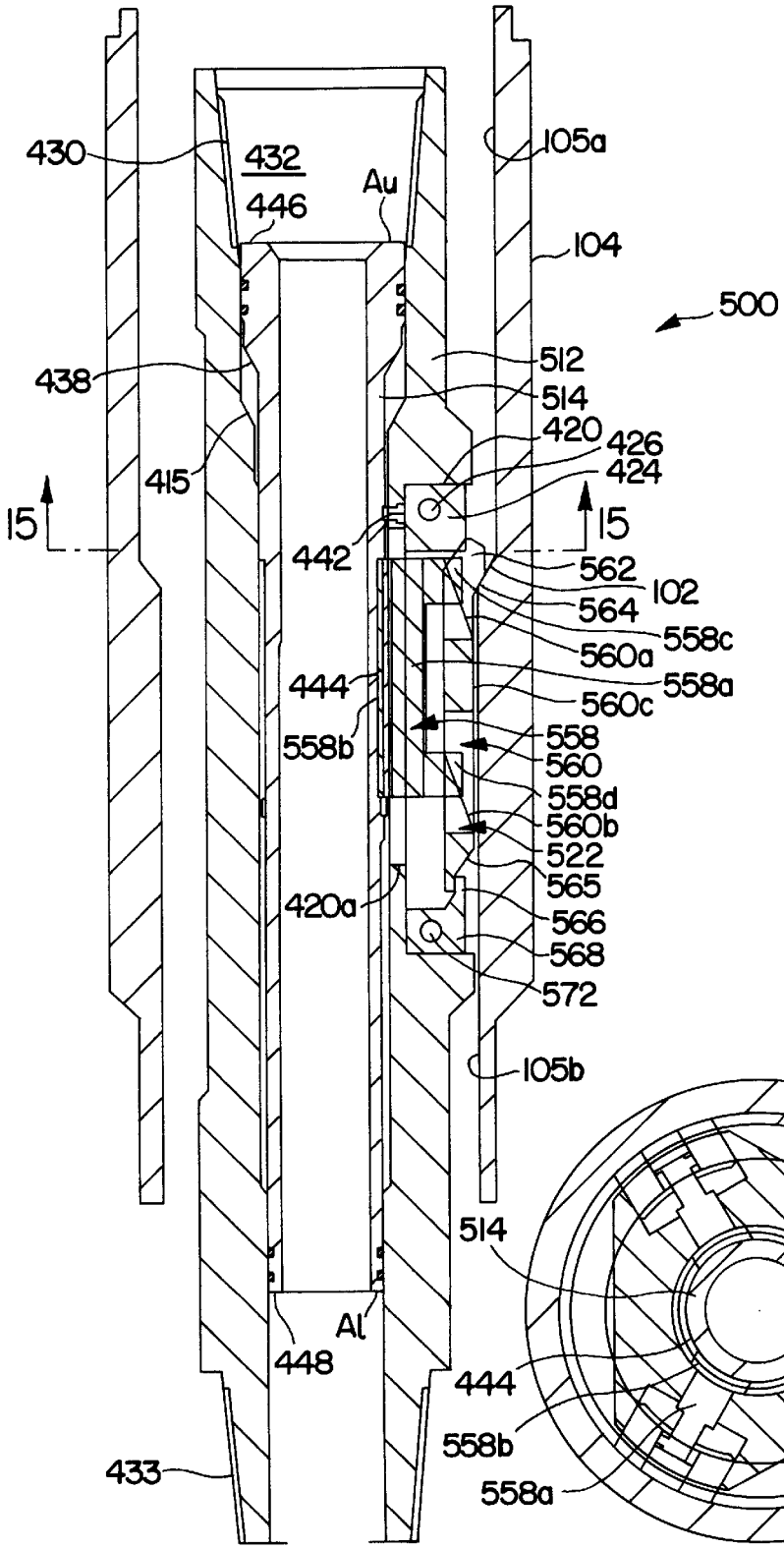
FIG. 14 is an enlarged, schematic, cross-sectional view of a temporary no-go assembly resting on a no-go shoulder within a main wellbore casing according to a fourth preferred embodiment of the present invention.
Figure 15:
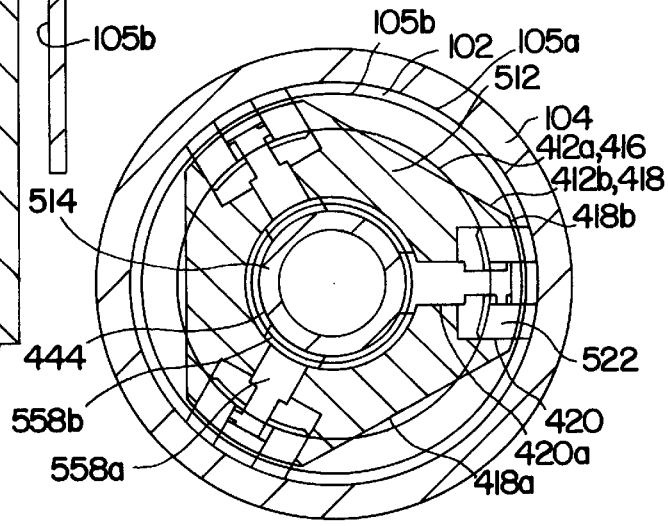
FIG. 15 is a top, sectional view of FIG. 14 along line 15—15.

Referring to FIGS. 14 and 15, a temporary no-go assembly 500 for interfacing with a no-go shoulder 102 within main wellbore casing 104 according to a fourth preferred embodiment of the present invention is illustrated. Above no-go shoulder 102, main wellbore casing 104 has an inner diameter 105*a*. Below no-go shoulder 102, main wellbore casing 104 has an inner diameter 105*b*, which is smaller than inner diameter 105*a*. No-go shoulder 102 is preferably conical.

Temporary no-go assembly 500 generally includes a mandrel 512 and an inner mandrel 514 disposed within mandrel 512. Mandrel 512 preferably has a substantially identical structure to mandrel 412 of temporary no-go assembly 400. Similarly, inner mandrel 514 preferably has a substantially identical structure to inner mandrel 414 of temporary no-go assembly 400. As is explained in greater detail hereinbelow, temporary no-go assembly 500 has key assemblies 522 that are similar to, but contain some modifications from, key assemblies 422 of temporary no-go assembly 400.

Each key assembly 522 generally includes a key retractor 558 and a key 560. Each key retractor 558 preferably has a retaining web portion 558*a* with a flange 558*b* received in annular recess 444 of inner mandrel 514. Each key retractor 558 also preferably has retractor arms 558*c* and 558*d*. Key retractor 558 is preferably identical to, and thus interchangeable with, key retractor 458 of temporary no-go assembly 400.

Each key 560 preferably has cam surfaces 560*a* and 560*b*. Cam surfaces 560*a* and 560*b* interface with retractor arms 558*c* and 558*d* of key retractor 558, respectively. Each key 560 preferably also has an upper portion 562 designed to engage no-go shoulder 102 of main wellbore casing 104. Each upper portion 562 preferably has a conical external surface 564 for mating with no-go shoulder 102. Each upper portion 562 also preferably engages spacer member 424 to help secure key 560 in slot 420. Each key 560 preferably further has a lower portion 565 designed to engage an upper portion 566 of a spacer member 568 to help secure key 560 within slot 420. A threaded hole 572 receives a threaded pin (not shown) to secure spacer member 568 within slot 422. Although not shown in FIG. 14, each key 560 is biased radially outwardly from slot 420 by a spring or springs, as is conventional. Alternatively, each key 560 may be biased radially outward from slot 420 by a hydraulic piston or pistons. Such hydraulic pistons may not be expanded until key assemblies 522 are proximate no-go shoulder 102, so as to prevent key assemblies 522 from riding on main wellbore casing 104. In addition, each key 560 may be formed from a spring steel, spring steel alloy, or other conventional spring material to facilitate the expansion and retraction of keys by the hydraulic pistons. Furthermore, each key 560 formed from a spring material may have a plurality of slots formed therein so as to optimize the spring force of the key.

Referring to FIGS. 5, 6, 14, and 15 in combination, temporary no-go assembly 500 may be coupled on the work string having orientation nipple 202, packer 204, hollow whipstock 206, pilot lug 208, running tool 210, and orientation sub 212, preferably via threads 433. The depth of no-go shoulder 102, and thus the relative distance between no-go shoulder 102 and target depth 24*a*, are known. Therefore, the work string may be formed so that pilot lug 208 is positioned at target depth 24*a* when key assemblies 522 rest on no-go shoulder 102. Packer 204 is preferably a packer which is initially hydraulically set with a relatively low pressure, and is then fully set with a relatively high mechanical force created by transferring weight from the rig hoist system supporting the work string and/or additional hydraulic pressure.

When key assemblies 522 rest on no-go shoulder 102, the following steps are preferably performed to precisely locate pilot lug 208 at target depth 24*a*. First, using conventional techniques, the work string, key assemblies 522, and pilot lug 208 are oriented to the desired relationship with the high side of main wellbore 200 by orientation sub 212 and a wire-line survey tool or work string conveyed MWD tool. Second, some work string weight is used to cause key assemblies 522 to bear down on no-go shoulder 102, such as, by way of example, releasing tension in the conventional rig hoist system on semi-submersible 14 supporting the work string. This transfer of work string weight positively locates temporary no-go assembly 500 axially and rotationally. More specifically, the transfer of work string weight causes external surface 564 of upper portions 562 of keys 560 to bear down on no-go shoulder 102, loading keys 560. Third, the orientation of the work string and thus pilot lug 208 within main wellbore casing 104 are verified to be within a specified range. Fourth, the work string is pressured up so as to perform the initial setting of packer 204. The pressure necessary to perform this initial setting is preferably low enough so as to minimize or eliminate any "ballooning effect" and/or stretching of the work string below no-go shoulder 102. Fifth, the pressure in the work string is increased, and a pressure differential created by the varying cross-sectional areas $A_u$ and $A_l$ of inner mandrel 514 causes inner mandrel 514 to begin sliding downward within mandrel 512. As inner mandrel 514 begins to slide downward, shear pins 442 are sheared, and key retractors 558 retract keys 560 away from no-go shoulder 102. More specifically, cam surfaces 560*a* and 560*b* cooperate with retractor arms 558*c* and 558*d* so as to retract upper portions 562 of keys 560 radially inward. Keys 560 are now unloaded, and annular shoulder 438 of inner mandrel 514 rests against annular shoulder 415 of mandrel 512. Sixth, additional work string weight is transferred from the rig hoist system to fully set packer 204. As will be appreciated by one skilled in the art, such weight is transmitted through mandrel 512, past no-go shoulder 102, and eventually to packer 204 because of the retraction and unloading of keys 560. Alternatively, if packer 204 is solely hydraulically set, the work string may be pressured up to a point where key 560 is retracted and packer 204 is fully set in a single step. As will also be appreciated by one skilled in the art, the work string weight transferred to key assemblies 522 may be removed after packer 204 is initially set, but before keys 560 are retracted, if desired.

Significantly, unlike conventional fixed no-go sleeve 32 of FIG. 2, it is not necessary to lift temporary no-go assembly 500 above no-go shoulder 102 so as to fully set packer 204. Therefore, temporary no-go assembly 500 avoids the inaccuracies associated with such lifting that would endanger the successful milling of a window in main wellbore casing 104 exactly at target depth 24*a*. In addition, unlike conventional fixed no-go sleeve 32 of FIG. 2, and the work string may be moved downhole past no-go shoulder 102 without bringing the work string top hole to remove temporary no-go assembly 500. The ability to not have to remove temporary no-go assembly 500 allows milling or other downhole operations to proceed and minimizes the number of work string trips into the well.

Referring now to FIGS. 7, 8, 14, and 15 in combination, temporary no-go assembly 500 may be coupled to work string 227 having mill anchor 222 and mill guide 224, preferably via threads 433. The depth of no-go shoulder 102, and thus the relative distance between no-go shoulder 102 and target depth 24*b*, are known. Therefore, the work string may be formed so that mill anchor 222 is positioned at target depth 24*b* when key assemblies 522 rest on no-go shoulder 102.

Mill anchor 222 is preferably initially hydraulically set with a relatively low pressure, and is then fully set with a relatively high mechanical force created by transferring weight from the rig hoist system supporting the work string. Alternatively, mill anchor may be solely hydraulically set. Therefore, using procedures substantially identical to the procedures described above in connection with pilot lug 208, temporary no-go assembly 500 may be used to precisely located mill anchor 222 exactly at target depth 24*b*, without the above-described disadvantages of conventional fixed no-go sleeve 32 of FIG. 2.

From the above, one skilled in the art will appreciate that the present invention provides improved apparatus and methods for precisely locating downhole tools relative to a predetermined target depth. The apparatus and methods of the present invention are economical to manufacture and use in a variety of downhole applications.

The present invention is illustrated herein by example, and various modifications may be made by a person of ordinary skill in the art. For example, numerous geometries and/or relative dimensions could be altered to accommodate specific applications of the present invention. As another example, although the present invention has been described in connection with the precision locating of multilateral well downhole tools such as a packer and hollow whipstock, or a mill anchor and mill guide, the present invention is fully operable with a wide variety of conventional downhole tools. As a further example, although when the present invention is used to precisely locate a packer and hollow whipstock, or a mill anchor and mill guide, the no-go shoulder or nipple within the casing is preferably located above the target depth, the no-go shoulder or nipple within the casing may be located above or below the target depth when using the present invention with other downhole tools or processes. As a further example, the step of orienting a pilot lug or a mill anchor/mill guide to the desired relationship with the high side of a main wellbore, and the step of verifying such orientation, may not be required when the present invention is used with other downhole tools or processes. As a further example, although the present invention has been described in connection with the drilling and completion of an offshore, multilateral well from a floating drilling rig, it is fully applicable to the drilling and completion of offshore, vertical wells from a floating drilling rig. As a further example, the present invention is also applicable to the drilling and completion of offshore wells from a fixed platform, and to the drilling and completion of on-shore wells in situations where conventional gamma ray survey tools cannot accurately position a downhole tool relative to a predetermined target depth.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

What is claimed is:

1. A temporary no-go assembly for use in locating a downhole tool at a predetermined target depth in a casing, the casing having a no-go shoulder, the assembly comprising:

a no-go sleeve for interfacing with the no-go shoulder; and an actuating system for releasing the assembly from the no-go sleeve.

2. The temporary no-go assembly of claim 1 wherein the no-go sleeve has a first slot formed therein, the assembly further comprises a mandrel disposed within the no-go sleeve and having a second slot formed therein proximate the first slot, and wherein the actuating system comprises:

an inner mandrel disposed within the mandrel, the inner mandrel having a first end with a first cross-sectional area and a second end with a second cross-sectional area smaller than the first cross-sectional area; and a lug disposed within the first and second slots.

3. The temporary no-go assembly of claim 2 wherein a first portion of the no-go sleeve has an external surface, and further comprising:

a plurality of the first slots spaced around the circumference of the external surface;

a plurality of the second slots formed in the mandrel proximate the first slots; and a plurality of lugs disposed within the first and second slots.

4. The temporary no-go assembly of claim 3 wherein the external surface allows fluid to bypass the no-go sleeve when the no-go sleeve interfaces with the no-go shoulder.

5. The temporary no-go assembly of claim 4 wherein the mandrel further comprises a first coupling mechanism at an upper end of the mandrel for removably engaging with a work string, and a second coupling mechanism at a lower end of the mandrel for removably engaging with the work string.

6. The temporary no-go assembly of claim 2 wherein the actuating system comprises:

a lug recess formed in an external surface of the inner mandrel proximate the second slot; and a cam surface running from a lower end to an upper end of the lug recess.

7. The temporary no-go assembly of claim 6 wherein the lug comprises:

a head; and a retaining web extending radially inward from the head for slidably engaging with the cam surface.

8. The temporary no-go assembly of claim 7 wherein:

the cam surface comprises a groove running from the lower end of the lug recess to the upper end of the lug recess; and the retaining web comprises a flange for interfacing with the groove.

9. The temporary no-go assembly of claim 2 wherein the actuating system comprises:

a contacting area on an external surface of the inner mandrel for abutting against the lug; and an annular recess on the external surface proximate the contacting area.

10. The temporary no-go assembly of claim 9 wherein the actuating system comprises a spring disposed in the first slot proximate the lug.

11. The temporary no-go assembly of claim 10 wherein the actuating system comprises a spring retaining member disposed in the first slot between the lug and the spring.

12. A method of locating a downhole tool at a predetermined target depth in a well, comprising the steps of:

forming a no-go shoulder in a casing;

coupling a downhole tool, an anchoring system, and a temporary no-go assembly to a work string, the temporary no-go assembly comprising:

a no-go sleeve for interfacing with the no-go shoulder; and an actuating system for releasing the assembly from the no-go sleeve; and running the work string into the casing until the no-go sleeve rests on the no-go shoulder.

13. The method of claim 12 wherein the no-go sleeve has a first slot formed therein, the temporary no-go assembly further comprises a mandrel disposed within the no-go sleeve and having a second slot formed therein proximate the first slot, and wherein the actuating system comprises:

an inner mandrel disposed within the mandrel, the inner mandrel having a first end with a first cross-sectional area and a second end with a second cross-sectional area smaller than the first cross-sectional area; and a lug disposed within the first and second slots.

14. The method of claim 13 further comprising the steps of:

transferring work string weight to positively locate the no-go sleeve on the no-go shoulder;

pressuring the work string to initially set the anchoring system; and increasing a pressure in the work string so that the inner mandrel slides relative to the mandrel.

15. The method of claim 14 wherein the sliding of the inner mandrel causes the actuating system to retract the lug from the first slot.

16. The method of claim 15 wherein the actuating system comprises:

a lug recess formed in an external surface of the inner mandrel proximate the second slot; and a cam surface running from a lower end to an upper end of the lug recess;

wherein the sliding of the inner mandrel causes the cam surface to retract the lug from the first slot.

17. The method of claim 16 further comprising the step of transferring additional work string weight to fully set the anchoring system.

18. The method of claim 13 further comprising the steps of:

transferring work string weight to positively locate the no-go sleeve on the no-go shoulder;

pressuring the work string so as to fully set the anchoring system and to cause the inner mandrel to slide relative to the mandrel;

wherein the sliding of the inner mandrel causes the actuating system to retract the lug from the first slot.

19. The method of claim 14 wherein the actuating system comprises:

a contacting area on an external surface of the inner mandrel for abutting against the lug; and an annular recess on the external surface proximate the contacting area;

wherein the sliding of the inner mandrel disposes the annular recess opposite the lug.

20. The method of claim 19 wherein the actuating system comprises a spring disposed in the first slot proximate the lug, and further comprising the steps of:

removing work string weight from the no-go sleeve to allow the spring to move the lug out of the first slot; and transferring work string weight to fully set the packer.

21. The method of claim 13 wherein the actuating system comprises:

a contacting area on an external surface of the inner mandrel for abutting against the lug; and an annular recess on the external surface proximate the contacting area;

and further comprising the steps of:

transferring work string weight to positively locate the no-go sleeve on the no-go shoulder;

pressuring the work string so as to fully set the anchoring system and to cause the inner mandrel to slide relative to the mandrel;

wherein the sliding of the inner disposes the annular recess opposite the lug.

22. The method of claim 12 wherein the well is drilled from a floating drilling rig.

23. The method of claim 22 wherein the well is a multilateral well.

* * * * *